United States Patent [19]

Gorr

[11] 4,044,672

[45] Aug. 30, 1977

[54] PRINTING MACHINE, IN PARTICULAR AN OFFICE OFFSET MACHINE WITH MEANS FOR PRE-CURVING THE MASTER

[75] Inventor: Theodor Wilhelm Gorr, Birkerod, Denmark

[73] Assignee: Zeuthen & Aagaard A/S, Glostrup, Denmark

[21] Appl. No.: 600,448

[22] Filed: July 30, 1975

[30] Foreign Application Priority Data

Aug. 5, 1974 Denmark ..... 4169/74

[51] Int. Cl.[2] ..... B41F 1/28

[52] U.S. Cl. ..... 101/132.5; 101/132; 101/232

[58] Field of Search ..... 101/130, 131, 131.5, 101/132, 132.5, 407, 408, 409, 410, 142, 216, 217, 415.1; 271/80, 81, 82

[56] References Cited

U.S. PATENT DOCUMENTS

| | | | |
|---|---|---|---|
| 3,044,771 | 7/1962 | Norton | 271/53 |
| 3,046,009 | 7/1962 | Hartel | 101/409 X |
| 3,431,841 | 3/1969 | Tonkin et al. | 101/142 |
| 3,570,397 | 3/1971 | Styles | 101/122 X |
| 3,581,658 | 6/1971 | Shepherd | 101/132 |
| 3,839,959 | 10/1974 | Abendroth | 101/232 |
| 3,941,054 | 3/1976 | Spinger | 101/415.1 |

*Primary Examiner*—Edward M. Coven
*Attorney, Agent, or Firm*—Stevens, Davis, Miller & Mosher

[57] ABSTRACT

A printing machine, especially an office offset printing machine, in which a master before being wrapped around the master cylinder is pre-curved by sliding over an edge of one pivotable part of a bipartite table which part is tilted manually during the mounting of the master to expose said edge against which the master is guided by a roller positioned above the table and by a guiding and operating member arranged between the two parts of the table. The curvature may be preadjusted in accordance with the characteristics of the master by adjusting the relative end positions of said roller and said table edge. The end of the movable table part closest to the master cylinder forms together with a guiding plate a slot which guides the master until it is gripped by the master cylinder. By actuating a handle and thereby raising one end of the movable table part the other end is lowered and thus said slot facing the master cylinder is opened to avoid straightening of the pre-curved master.

11 Claims, 4 Drawing Figures

Figure 1:
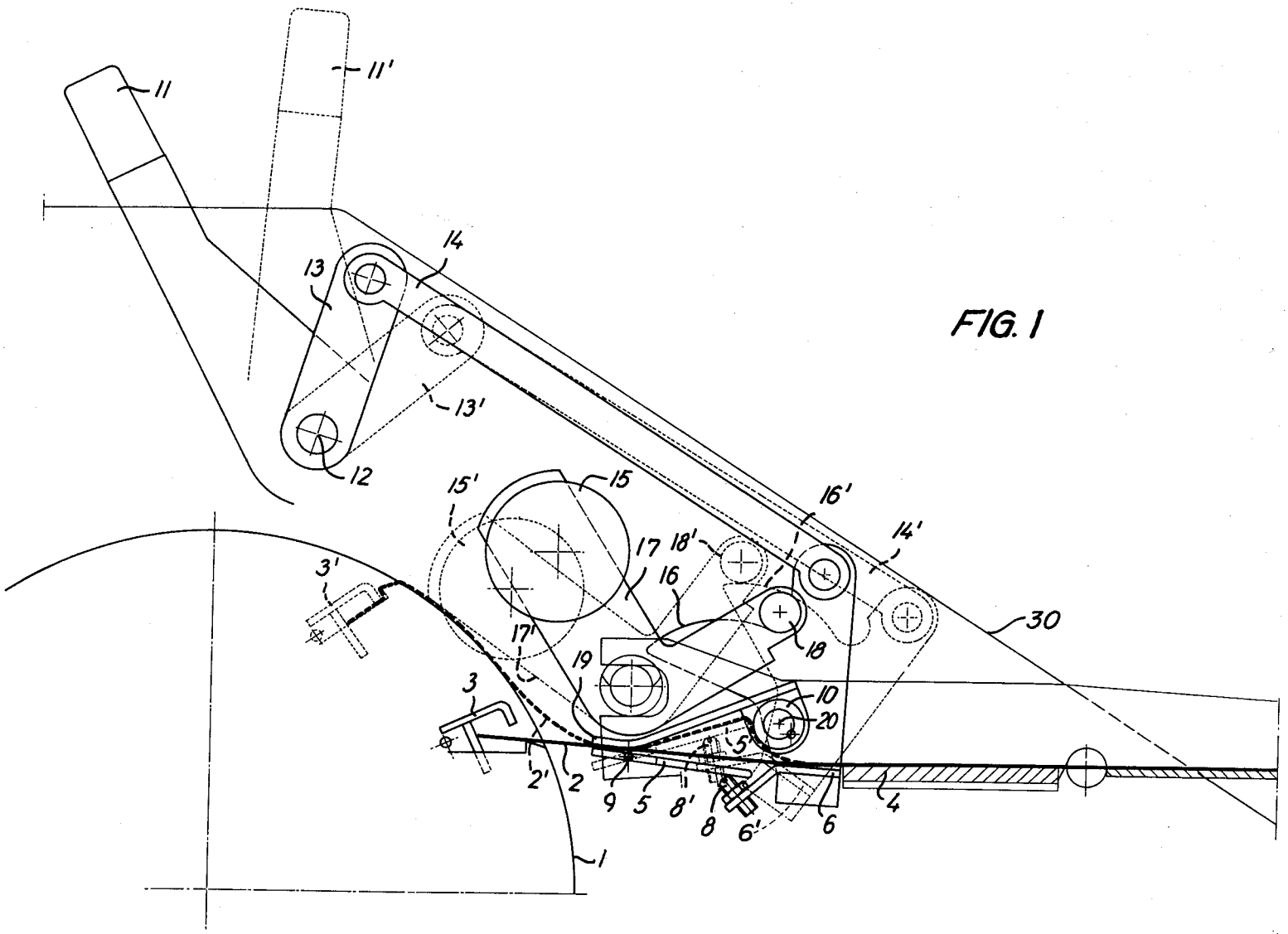

PRINTING MACHINE, IN PARTICULAR AN OFFICE OFFSET MACHINE WITH MEANS FOR PRE-CURVING THE MASTER

This invention relates to a printing machine, in particular an offset office machine comprising a cylinder with gripping members for a master to be wrapped around the cylinder, a table along which the master is advanced to the cylinder during the mounting operation and which comprises means for, by a sliding bending over an edge with a small radius of curvature, giving the master a pre-curvature so that it will more easily wrap itself around the master cylinder, and an operating member for actuating the pre-curving mechanism.

Such a mechanism is known in which the master is placed on a joggled stationary table, subsequently to which a transverse roller located above the table is swung down towards the joggle, so that during the continued advance the master is pulled over an edge.

It is an object of the present invention to provide a simplified construction by means of which it becomes possible to use a normally plane table so that the risk that the master, when being led into engagement with the cylinder, has its movement impeded by abutting against projecting edges is avoided.

According to the invention, this is achieved by the table comprising two parts, a stationary table part and a movable table part which is located closest to the master cylinder and pivotable around an axis parallel to the plane of said table and at right angles to the direction of advance of the master and by an operating member being provided for tilting said movable table part into a position in which its rear edge is located at a short distance from a guiding roller which is mounted rotatably around a stationary shaft in the machine and thereby providing a means for giving the master drawn along the table between said edge and said roller a pre-curvature. Constructively, this entails the additional advantage that the pivotal part is located below the master, and need only have a relatively small extent in the direction of movement of the master.

Under certain circumstances and in the case of certain types of masters defects in the printing may occur. A further development of the invention is based on the recognition that such defects may be put down to the pre-curvature in combination with the special nature of the master, and, consequently, it is desirable that it is possible to adjust the degree of pre-curvature, and according to the invention the printing machine therefore expediently comprises means for pre-adjusting the relative position of said rear edge of the movable part of the table and the guiding roller obtained after the actuation of said operating member and thereby for adjusting the degree of curvature of the master.

These adjustment means may also serve advantageously in cases where no defects, per se, occur in the printing, but where it is only a question of adapting the pre-curvature in dependence on the type of master used. The fact is that the different types of masters have differing properties, e.g. differing rigidities, depending on the composition and material of the master, and it may be expedient to pay due regard to this by a suitable pre-adjustment.

Figure 2:
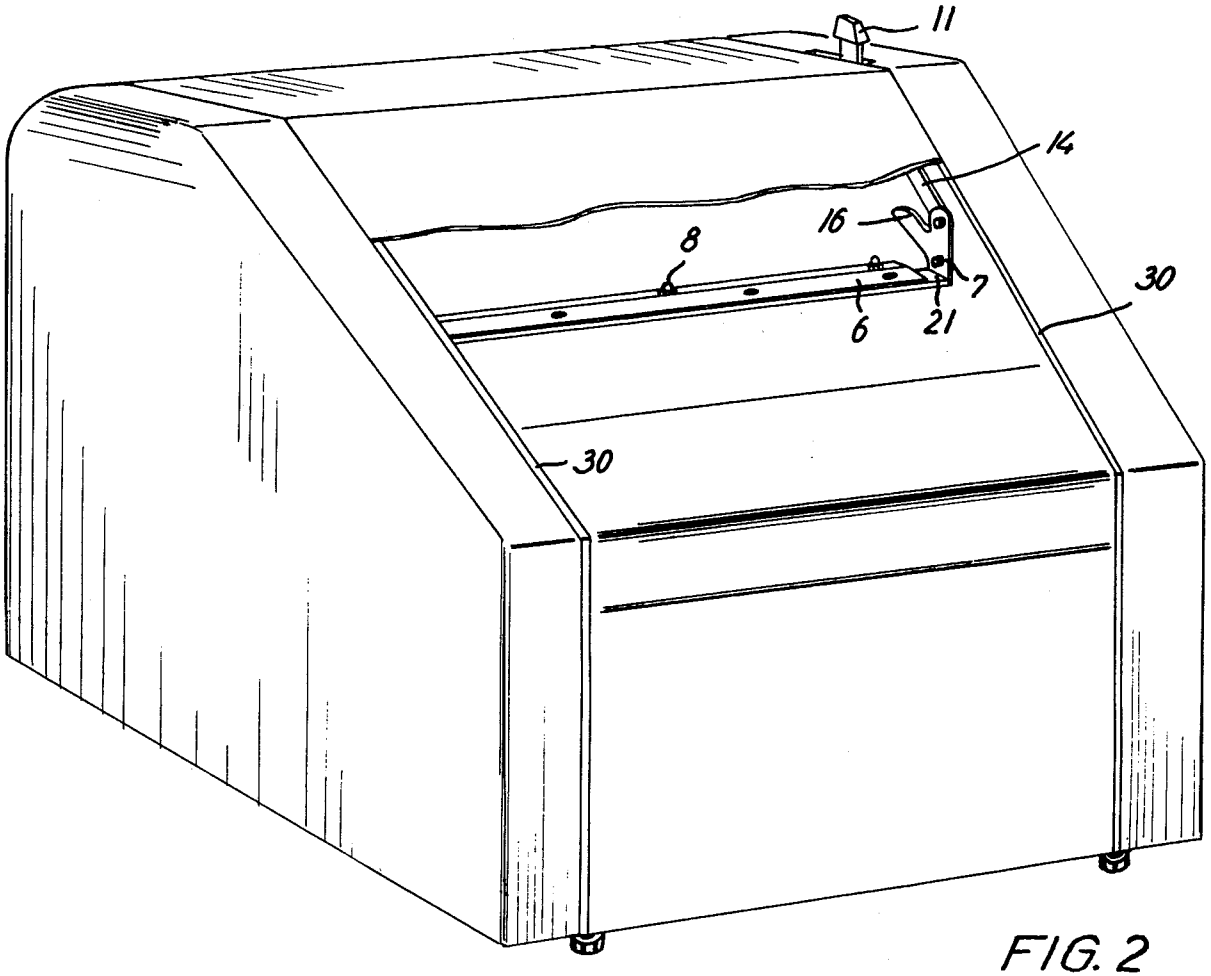
Figure 3:
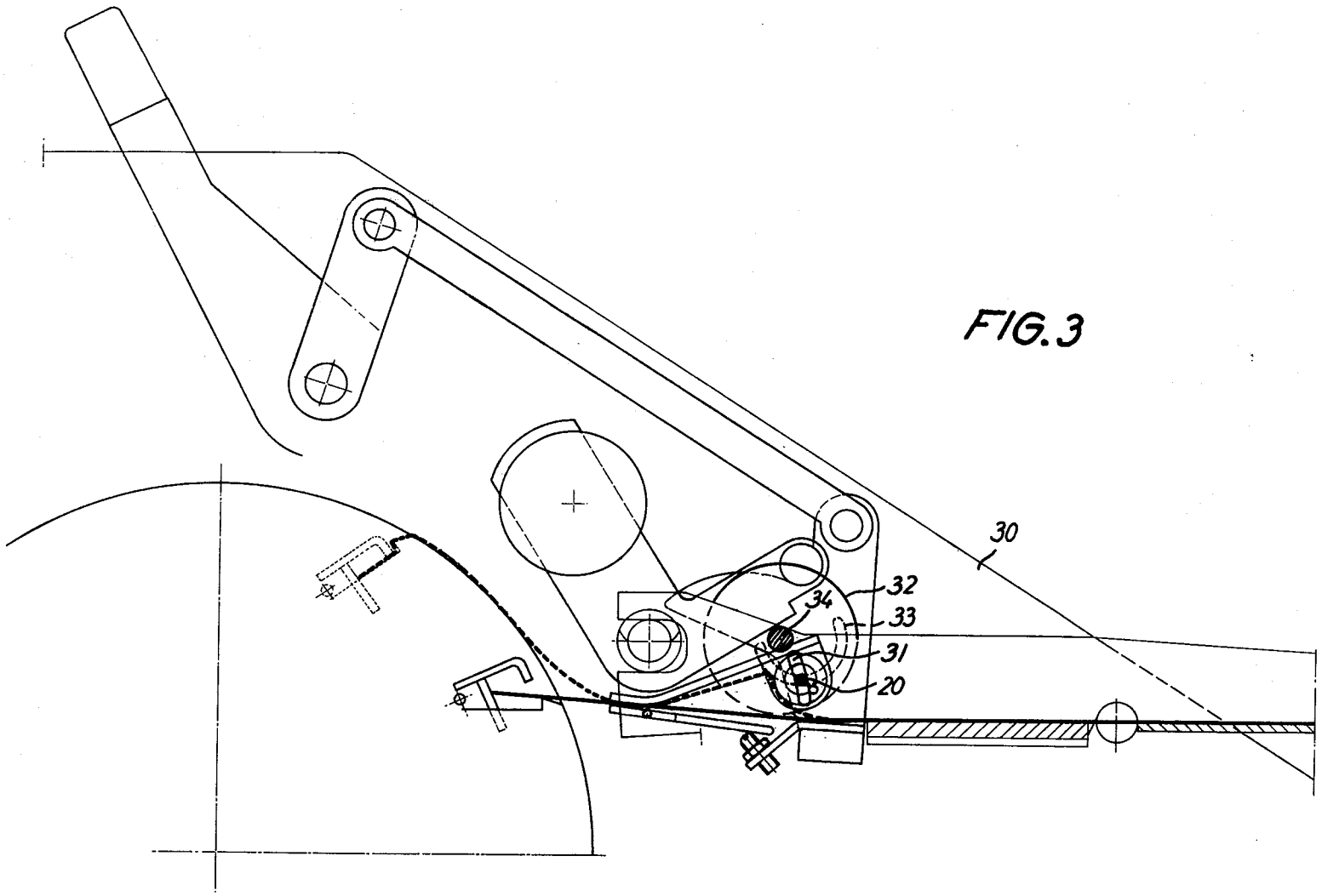
Figure 4:
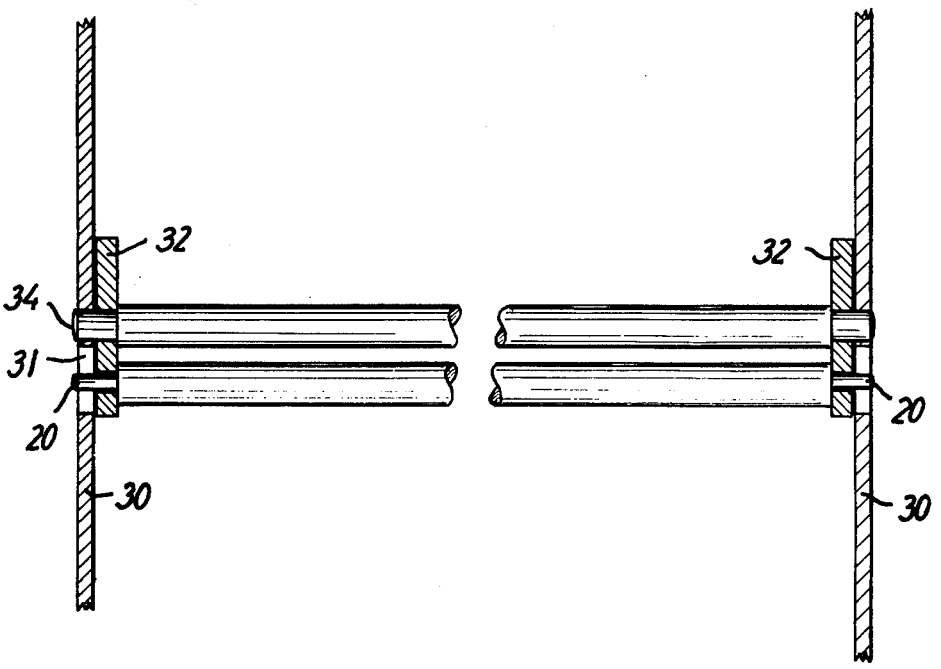

The invention is explained in greater detail on the basis of the purely diagrammatical accompanying drawings wherein FIG. 1 shows a longitudinal section through those parts of an offset office printing machine essential for understanding the invention, FIG. 2 shows said machine seen in perspective and with the cover cut open and some of the parts removed to show the members actuating the movable part of the table guiding the master, FIG. 3 shows a longitudinal section through another embodiment of an offset office printing machine and FIG. 4 shows a section through a part of the embodiment of FIG. 3.

An embodiment of the machine seen from the outside is shown in FIG. 2 with frame 30 and cover but the invention will in the following be described primarily with reference to the more diagrammatic illustration in FIG. 1 in which one of the parallel sides forming part of the frame is indicated by a line 30. The master cylinder and other parts of the machine are as usual mounted in and between the two sides of the frame and a more detailed description is therefore superfluous in this connection.

In FIG. 1, the circle 1 designates the master cylinder around which a master is to be wrapped. The master is shown in fully drawn lines at 2 and by a thick dotted line at 2'. The master cylinder 1 which is mounted rotatably in the frame 30 of the machine has gripping members 3 which are also shown dotted at 3' in another position in which the gripping members 3 have gripped the end of the advanced master 2, and the master cylinder 1 has turned through a slight angle counter-clockwise.

The master 2 to be mounted is supported by a table comprising a stationary table part 4 and a pivotal table part 5, between which an angular guiding and operating part 6 is provided one leg of which projects in under and along one end of the movable table part 5. The angular operating part 6 is mounted on a bracket member 21 and is rotatable around an axis 7, FIG. 2, and carries at least one pressure member 8 which when said angular part 6 is turned clockwise (FIG. 1) around the axis 7 presses against the underside of the pivotal table part 5, so that the said table part 5 is tilted into the position 5' and the angular part 6 into the position 6' shown in dotted lines. The table part 5 turns counter-clockwise around an axis 9, whereby its rear edge, over which the curving operation is to be performed, rises to the vicinity of the periphery of a guiding roller 10 which can turn around an axis 20. The roller 10 keeps the master 2' against the table part 5' during the advance of the master, so that a sliding bending over the rear edge is performed, the rear edge being rounded with a small radius of curvature. The angular guiding part 6 guides the master so as to secure contact with the roller 10 over a suitable angle.

The actuation of the table part 5 via the angular operating part 6 is effected from an operating member, e.g. a handle 11, which is shown in its actuated position at 11' and which can turn around an axis 12. The handle 11 is via a lever 13, a link 14 and the bracket member 21 connected to the angular operating part 6.

The degree of curvature imparted to the master during the mounting process is determined by the shape of the rear edge of the table 5 and the location of this rear edge in relation to the guiding roller 10. By this location being made adjustable, the degree of curvature may be varied and adapted to the properties of the master used. The adjustability can be brought about by either the roller 10 or the table part 5 or both being made adjustable. The roller 10 may for example be mounted in pivotable brackets which can be fixed in a chosen position, see FIG. 4. In the embodiment shown in FIGS. 1 and 2, the adjustability has been brought about in a particularly simple way by making the pressure member 8 adjustable in relation to the operating part 6. The pressure member may be a screw provided with a notch and screwed into a threaded hole in the operating part 6 and secured in position by means of a nut. Thus the end position of the table in relation to the roller may be adjusted.

The angle, through which the operating part 6 is turned when the handle 11 is switched into the position 11', is constant, but by an adjustment of the screw 8 the starting position of the table part 5 is adjusted and thereby the location of the rear edge of the table part 5 in the final position of the table. The degree of curvature becomes the larger the longer the screw 8 is screwed out of the operating part 6 in the direction towards the table part 5.

The member 21 carrying the operating part 6 is designed for actuating not only the movable table part 5 into the position 5', but also a moistening roller 15 into the position 15' shown in dotted lines when the handle 11 is switched into the position 11'. For this purpose, the bracket member 21 has a curved surface 16 which presses against a roller 18 located on one branch of a rotatable angular arm 17, in the other branch of which the shaft for one end of the moistening roller 15 is journalled.

The moistening unit may comprise two or more rollers and a moistening wick mounted in the frame. The moistening unit and the table may form separate units which are mounted in the machine so as to be easily detachable.

To ensure an accurate introduction of the front edge of the master into the gripping members 3 on the master cylinder 1, irrespectively of the type of master used, there has above the movable table part 5 been provided a guiding rail 19 which together with the front edge of the table during the mounting of the master forms a narrow guiding slot which opens when the handle 11 is operated to tilt the table part 5 and the master cylinder 1 starts turning counter-clockwise carrying along with it the master placed on the table. In this way it is avoided that the pre-curved master is straightened by being bent in the opposite direction when it leaves the guiding slot.

The construction described entails a simplified operational function, during which it is unnecessary to touch the master apart from the moment when the master is placed on the table and slid forwards to the gripping members 3. The effecting of the curving of the master and thereby of a smooth contact against the master cylinder 1 as well as the supply of etching liquid occur fully automatically, and the moistening unit is automatically disengaged when the handle, after the master cylinder has rotated a few turns, is returned to the position 11.

The mechanism is completely fool-proof, and the placing operation may be performed blindfolded. The operator does not at all see the members producing the curvature since they are situated under the master.

The embodiment in FIGS. 3 and 4 is shown in the same diagrammatic way as the embodiment shown in FIG. 1 and serves to illustrate that the roller 10 may be made pre-adjustable in which case it is not necessary that the pressure member 8 as described in connection with FIG. 1 is pre-adjustable. Only those parts of the mechanism which is necessary to understand the adjustability of the roller 10 are shown.

While in FIG. 1 the axle of the roller 10 is mounted stationarily in the frame 30 of the machine, it is in the embodiment in FIGS. 3 and 4 mounted slidable in curved slots 31 in the side plates of the frame 30. At both ends the axle 20 is supported by an adjustment wheel 32 by passing through a curved slot 33 in the adjustment wheel mounted on an axle 34. The slot 33 crosses the slot 31 and is positioned eccentrically in relation to the axle 34. Thus by turning one of the adjustment wheels 32 which are interconnected by the axle 34 the axle 20 of the roller 10 will move up and down in the slot 31 corresponding to an anticlockwise and a clockwise movement of the wheel, respectively.

What is claimed is:

1. A printing machine comprising a frame, a cylinder mounted on said frame with gripping members for a master to be wrapped around said cylinder, a table mounted on said frame along which the master is advanced to said cylinder during the mounting operation, said table comprising two parts, a stationary table part and a movable table part having front and rear edges, said front edge of said movable table part being positioned closer to said cylinder than said rear edge, said movable table part being located closer to the master cylinder than said stationary table part and pivotable around an axis positioned intermediate its front and rear edges which is parallel to the plane of said table and at right angles to the direction of advance of the master, a pivotable operating member positionable in contact with said movable table part for pivoting said movable table part about said axis, a stationary shaft mounted on said frame, and a guiding roller mounted rotatably around said stationary shaft and contactable by said master when being mounted, said movable table part being pivotable into a position in which its rear edge is located at a short distance from said guiding roller to enable the master to pass therebetween and alter the direction of travel of the master and to provide a means for giving pre-curvature to the master as it is advanced along the movable table part.

2. The printing machine as claimed in claim 1, including adjustable pressure means attached to said pivotable operating member to contact said movable table part to provide for pre-adjusting the relative position of said rear edge of said movable table part and said guiding roller after actuation of said pivotable operating member and thereby adjust the degree of curvature of the master.

3. The printing machine as claimed in claim 1 including a pivotable operating part which via a lever and link system is connected to said pivotable operating member which contacts the movable table part near the rear edge thereof.

4. The printing machine as claimed in claim 1, wherein said operating member comprises an adjustable pressure member which contacts the underside of the rear edge of said movable table part.

5. The printing machine as claimed in claim 1 including a moistening roller and a pivotable angular arm supporting said moistening roller on one end thereof and a contact roller on the other end thereof, said pivotable operating member having a curved surface in contact with said contact roller and comprising an adjustable pressure member which contacts the underside of said movable table part, said pivotable operating member upon being pivoted rotating said angular arm which carries said moistening roller so that said moistening roller contacts said master on said cylinder.

6. The printing machine as claimed in claim 1 including a guiding rail provided above said movable table part so as to form a slot with said movable table part through which the master can be guided into said gripping members on said master cylinder.

7. The offset office printing machined as claimed in claim 1, including a guiding plate positioned above said movable table part wherein the front edge of said movable table part together with said guiding plate above the table forms a slot through which said master passes upon being mounted.

8. An offset office printing machine comprising a frame, a master cylinder with gripping members for a master to be wrapped around said cylinder, a table along which the master is advanced to said cylinder during the mounting operation wherein said table comprises a stationary table part and a movable part having front and rear edges, said front edge of said movable table part being positioned closer to said cylinder than said rear edge and closer to said cylinder than said stationary table part and pivotable around an axis parallel to the plane of said table and at right angles to the direction of advance of the master, means for pivoting the rear edge of the movable table part upwardly into a tilted position, a roller having an axle mounted in the machine parallel with said rear edge for guiding said master closely around said rear edge, said means for tilting said movable table part comprising a pivotable bracket member carrying a table-operating and master-guiding angular member having a leg which protrudes under said rear edge of said movable table part and carries at least one contacting member for pressing against the underside of said movable table part and forcing it to pivot.

9. The offset office printing machine as claimed in claim 8, wherein said contacting member comprises a pre-adjustable pressure member.

10. The offset office printing machine as claimed in claim 8, wherein said roller cooperating with said movable table part is mounted in the frame of the machine.

11. The offset office printing machine as claimed in claim 8, including adjustment wheels interconnected by an axle mounted in said frame wherein said axle of said roller is guided in slots in the frame of the machine and supported at both ends in eccentric curved slots in said adjustment wheels.

* * * * *